US005320367A

United States Patent [19]

Landis

[11] Patent Number: 5,320,367

[45] Date of Patent: Jun. 14, 1994

[54] BRAKING METHOD AND APPARATUS FOR AN IN-LINE ROLLER SKATE

[76] Inventor: Robert M. Landis, 331 E. 29th St., New York, N.Y. 10016

[21] Appl. No.: 868,034

[22] Filed: Apr. 13, 1992

[51] Int. Cl.[5] ..... A63C 17/14

[52] U.S. Cl. ..... 280/11.2; 188/72.4; 303/89

[58] Field of Search ..... 280/11.2; 188/29, 57, 188/72.4, 72.5, 361, 365, 366, 367, 353; 303/89; 137/150; 192/88 B

[56] References Cited

U.S. PATENT DOCUMENTS

| | | | |
|---|---|---|---|
| 83,024 | 10/1868 | Barbarin | 137/150 |
| 577,628 | 2/1897 | Segerberg | 280/11.2 |
| 1,371,623 | 3/1921 | Ickenroth | 280/11.2 |
| 1,628,559 | 5/1927 | Showers | 188/2 R |
| 1,965,459 | 7/1934 | Fischer | 188/353 |
| 2,359,516 | 10/1944 | Frank | 188/152 |
| 2,366,093 | 12/1944 | Forbes | 188/72 |
| 2,944.636 | 7/1960 | Rockwell | 188/29 |
| 3,224,785 | 12/1965 | Stevenson | 280/11.2 |
| 3,288,251 | 11/1966 | Sakwa | 188/29 |
| 3,385,608 | 5/1968 | Waddell | 280/11.2 |
| 3,744,339 | 7/1973 | Martinson | 73/501 R |
| 3,880,441 | 4/1975 | Silver | 280/11.22 |
| 3,904,215 | 9/1975 | Bardy | 280/11.2 |
| 3,945,655 | 3/1976 | Banks et al. | 280/11.2 |
| 4,003,582 | 1/1977 | Maurer | 280/11.2 |
| 4,032,200 | 6/1977 | Farr | 303/116 |
| 4,076,266 | 2/1978 | Krausz | 280/87.04 A |
| 4,175,648 | 11/1979 | Sule | 188/344 |
| 4,295,547 | 10/1981 | Dungan | 280/11.2 |
| 4,300,781 | 11/1981 | Riggs | 280/11.2 |
| 4,943,075 | 7/1990 | Gates | 280/11.2 |
| 5,028,058 | 7/1991 | Olson | 280/11.22 |

FOREIGN PATENT DOCUMENTS

| | | | |
|---|---|---|---|
| 746228 | 4/1931 | France | 280/11.2 |
| 651868 | 4/1951 | United Kingdom | 280/11.2 |

OTHER PUBLICATIONS

Merriman Windjammer brochure: Air/Hydromechanical Actuation, Apr. 15, 1992.

Colder Products Co. advertisement: Subminiature couplings.

*Primary Examiner*—Eric D. Culbreth

*Attorney, Agent, or Firm*—Morgan & Finnegan

[57] ABSTRACT

A braking device for small recreational vehicles, such as roller skates or skateboards, having brake pads positioned in close proximity to the wheels of the recreational vehicle. The brake shoes are brought into operative contact with the wheels to effect braking under the action of a hand squeezable bulb. The braking assembly transmits the pressure created from squeezing a bulb through a conduit to a pressure activated member, such as an inflatable bladder, to displace the brake shoes to their braking position. Braking pressure may be maintained through the use of a valve. The braking conduit may be easily disengaged from the pressure activated member so that the recreational vehicle may alternatively be used in a conventional fashion having no braking capability.

7 Claims, 11 Drawing Sheets

BRAKING METHOD AND APPARATUS FOR AN IN-LINE ROLLER SKATE

FIELD OF INVENTION

This invention relates to a device for the braking of roller skates in general, and in particular for in-line roller skates that have a single row of wheels attached to the bottom of the skate.

BACKGROUND OF THE INVENTION

In-line roller skating is a physically beneficial sport that allows users to take advantage of the activity's low impact, high aerobic benefits. In-line roller skates, which have been patented and produced by many companies since the 1880's, are undergoing a current resurgence of popularity. Along with the increase in their popularity, there has been an increase in injuries resulting from safety hazards inherent in their usage. Traditionally, in-line roller skates have had little or no braking capability and frequently involve their users in accidents resulting in severe injury and in some cases fatal injury.

The in-line roller skates, also known as tandem roller skates, utilize two or more wheels arranged in tandem on the skate so as to rotate within the same vertical plane. Typically, the wheels or rollers are made of a resilient material and arranged with four rollers mounted in tandem from the front of boot to the rear of the boot. With this arrangement, all of the rollers are in contact with the ground at the same time, simulating the speed, maneuverability, balance and performance of ice skates.

The movement of the in-line roller skates by a user is usually achieved by gravitational forces such as rolling down a hill. This forward movement of the in-line roller skates may be hazardous if the hill is steep and the user develops an excessively high speed. As can be appreciated, the attainment of an excessively high speed using a conventional in-line roller skate can easily lead to injury in that the user may very likely be required to fall at a high speed to stop the skate.

A common method of controlling this speed is by turning off course or slid slipping across the hill. However, turns using an in-line roller skate to control speed may be a problem when the speed is excessively high. This method of reducing speed is also hazardous since it too can cause the user to fall at high speeds.

Another method of controlling speed is to drag a braking device attached to the front or rear of the skate against the ground. Several current in-line roller skates do come with a braking device which is attached to and extended downward from the skate frame. This type of braking device basically consists of a cylindrical-shaped braking pad that has a central threaded stud which is affixed to the rear of the skate frame with a locking nut and screw. To slow down the user's speed, the brake pad is pressed into frictional contact with the ground.

Unfortunately, this type of braking mechanism requires the user to operate the brake by clumsy if not dangerous foot movement since the user must lift the front of one skate to drag the brake while precariously balancing and steering with the other skate. In addition, these passive types of braking mechanisms have presented a problem to beginners not yet proficient in the use of in-line roller skates and in some cases experienced users have found that the scope of the possible activity on such recreational devices is limited by the lack of a selective braking control.

Advances in in-line roller skate brakes have been focused more on the material of the brake pad, than on the braking mechanism itself. For example, see U.S. Pat. No. 5,028,058 entitled "HUB AND BRAKE ASSEMBLY FOR IN-LINE ROLLER SKATE." Moreover, no braking system has achieved any degree of popularity for in-line roller skates despite the invention of one or more braking devices for conventional roller skates and skateboards.

Thus, there is a need to provide a braking device for such in-line roller skates that is safe and simple in its use, which can be inexpensively incorporated within existing in-line roller skate design.

Accordingly, an object of the present invention is to provide a wheel braking assembly for small recreational vehicles such as roller skates and skateboards to increase their safety and maneuverability without impeding the normal operation of their wheels.

Another object is to provide a braking apparatus for small. recreational vehicles such as roller skates and skateboards that applies its frictional force to the outer surface of the wheels instead of the ground.

A further object is to provide a braking mechanism that can be controlled by the rider wherein the brake shoe or disc is hand activated remotely by an operable squeeze device connected to the brake by a conduit, eliminating the need to operate the brake by foot movement.

It is yet another object to provide a brake which will operate only on the front and rear wheels of an in-line roller skate to prevent lock up of the two inner wheels should the brake be applied while traversing uneven surfaces.

It is still a further object to provide a brake which will operate only on one wheel of a skate in order to limit the wear to one wheel, and thereby reduce the cost of manufacturing and operating the skate while still providing a braking action to the skate.

It is yet a further object to provide a braking assembly for skating which may be used in areas previously considered too dangerous for skating.

It is yet another object to provide a braking apparatus that allows the skate's wheels to be locked, which permits the user to walk up or down stairs and walk in areas where skating is inappropriate or unsafe.

It is still another object to provide a braking apparatus for small vehicles which is simple in design and use, and economical to manufacture.

The foregoing objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art.

SUMMARY OF THE INVENTION

In accordance with these and other objects of the invention, a brief summary of the present invention is presented. Some simplifications and omissions may be made in the following summary, which is intended to highlight and introduce some aspects of the present invention, but not to limit its scope. Detailed descriptions of a preferred exemplary embodiment adequate to allow those of ordinary skill in the art to make and use the inventive concepts will follow in later sections.

In one embodiment, the present invention provides a wheel brake assembly for a small recreational vehicle such as an in-line roller skate or a skateboard having hand activated, resilient brake shoes mounted between the bottom of the skate boot or platform, and the wheels or rollers. The brake assembly comprises brake shoes that are moved into a frictional engagement with the outer surface of the wheels by a fluid-pressure system that is remotely activated by the user.

According to a broad aspect of the invention, there is provided a braking apparatus for small recreational vehicles having a frame therein, that applies a braking force to the wheels of the vehicle, comprising a braking member carried by the frame; at least one frictional member mounted to one surface of the braking member and positioned adjacent to the wheels for displacement against the wheels; an expandable pressure-activated member mounted on the opposite surface of the braking member from the surface that the frictional member is mounted; a hand operable member for selectively expanding the pressure-activated member, thereby displacing the braking member and forcing the frictional member against the wheels; and a conduit connected on one end to the pressure-activated member and connected on the other end to the hand operable member for transmitting pressure from the hand operable member to the pressure-activated member.

In one embodiment, the pressure-activated member is an inflatable bladder that forces the brake shoe against the outer circumference of the wheels. In a second embodiment, the pressure-activated member is an air cylinder, that forces the brake shoe against the outer circumference of the wheels. In a third embodiment, the pressure-activated member is a pair of inflatable bladders, that force a pair of brake shoes against the side walls of the wheels.

It has been found that the brake apparatus, when manually controlled as ascribed to herein is effective not only in achieving the end of safety but also in increasing the overall speed when racing down a steep obstacle course, due to the improved control provided by the brake. Instead of dragging one heel, side slipping or turning off course to reduce speed, a gradual braking effect may be applied exactly when desired. Utilization of an effective brake permits skating down narrow paths and allows greater flexibility in choosing locations of turns on hills, thus making the sport more enjoyable as well as less dangerous. Additionally, the brake shoes may be locked against the wheels of a roller skate to permit walking therewith.

DETAILED DESCRIPTION OF PREFERRED EMBODIMENTS

Figure 1:
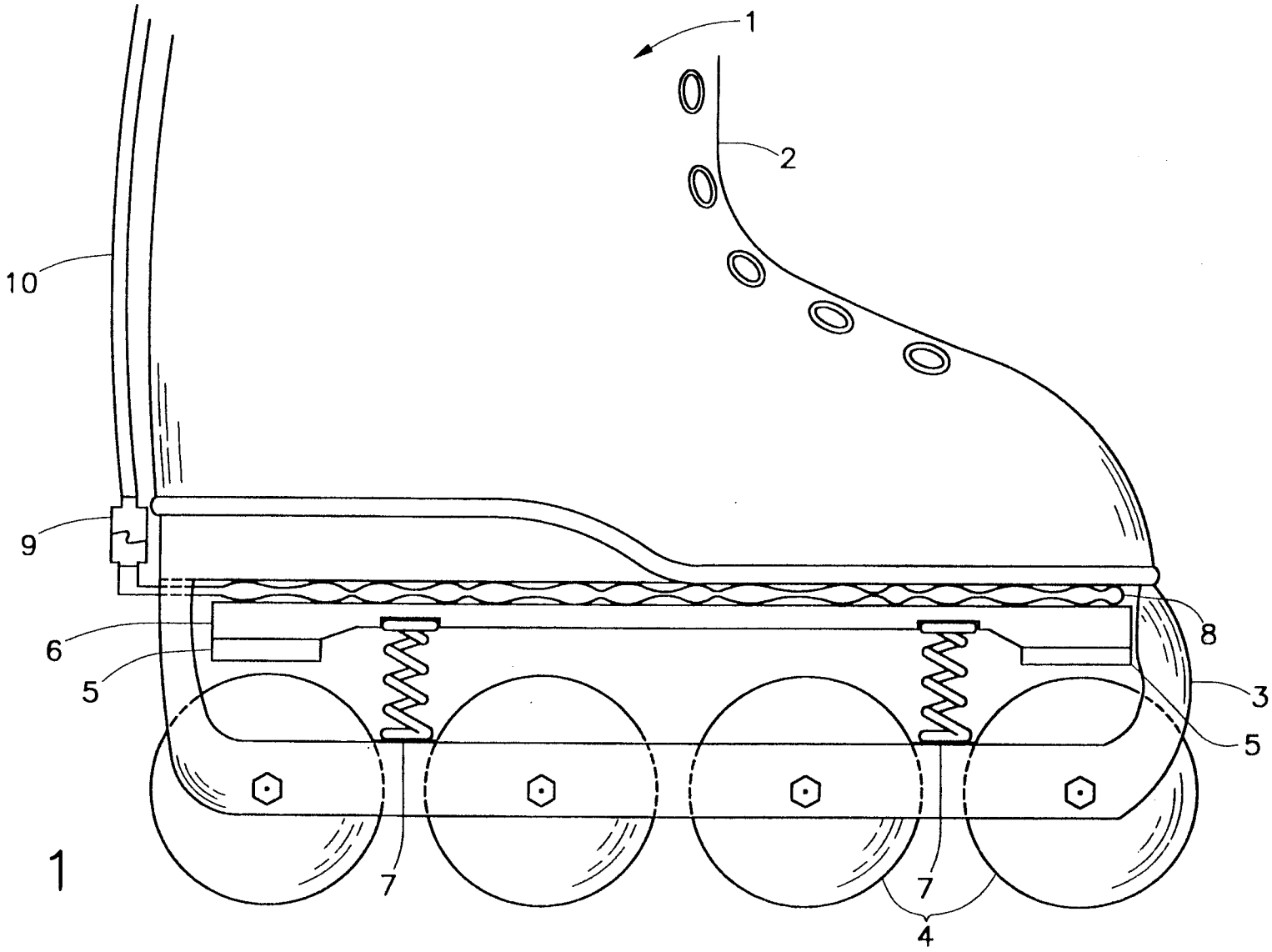
FIG. 1 is a side elevation view of a typical in-line roller skate with the brake assembly of the present invention in an inactive state.
Figure 2:
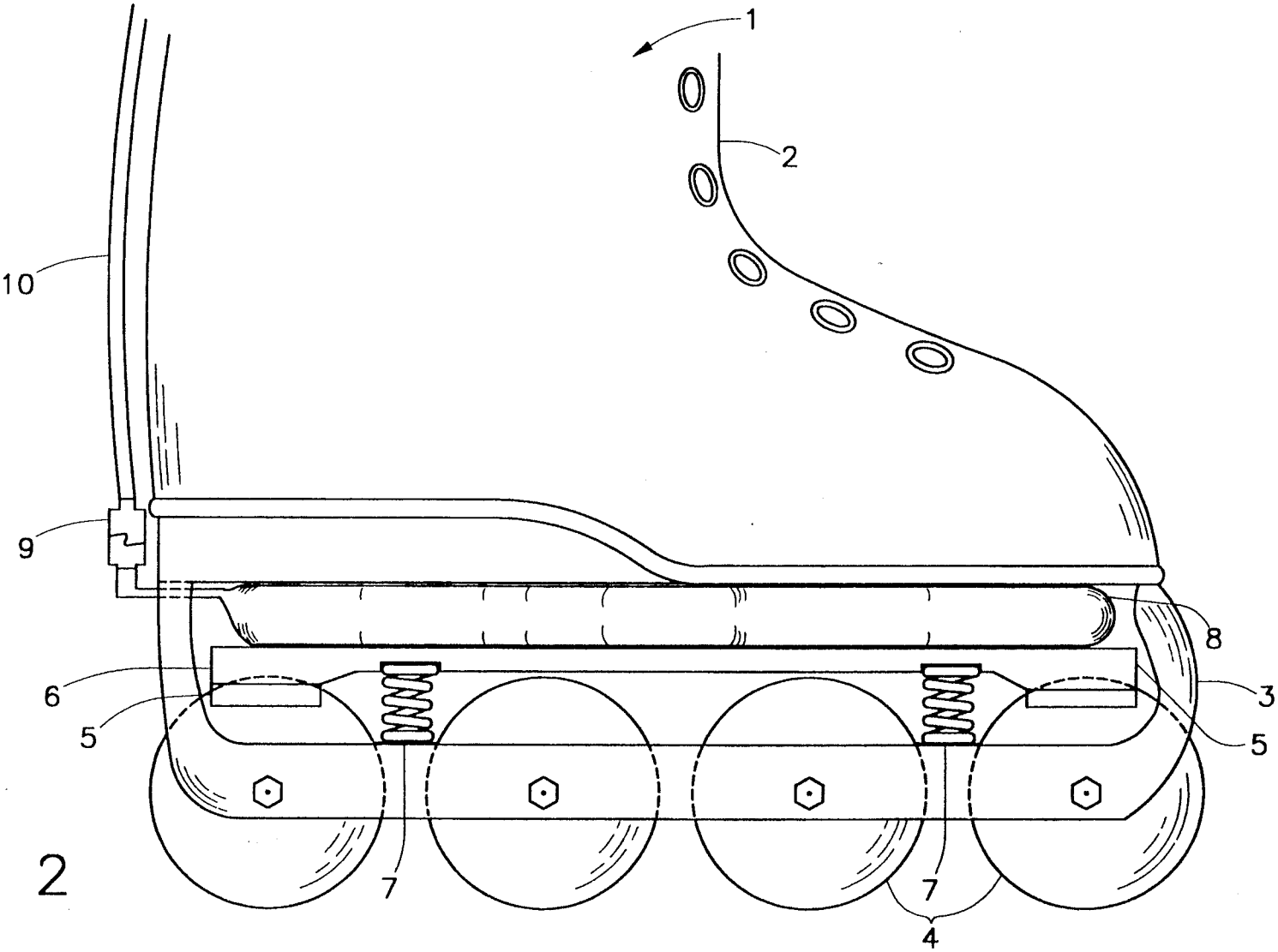
FIG. 2 is a side elevation view of a typical in-line roller skate with the brake assembly of the invention in an active state.
Figure 3:
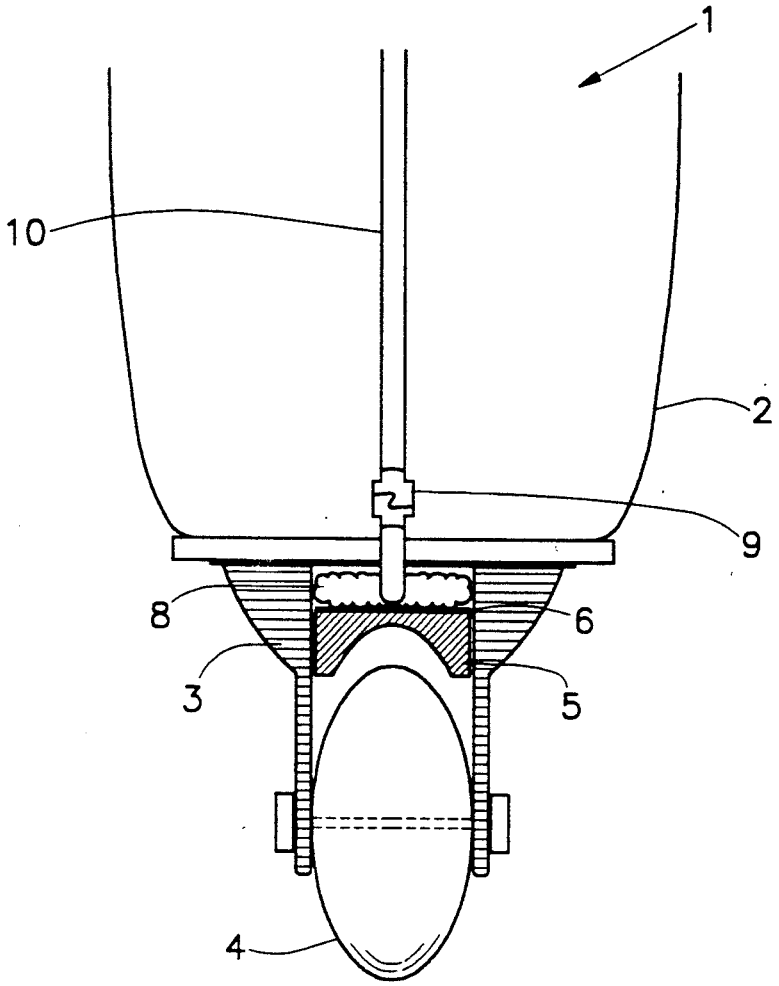
FIG. 3 is a rear elevation view of a typical in-line roller skate with the brake assembly of the present invention in an inactive state.
Figure 4:
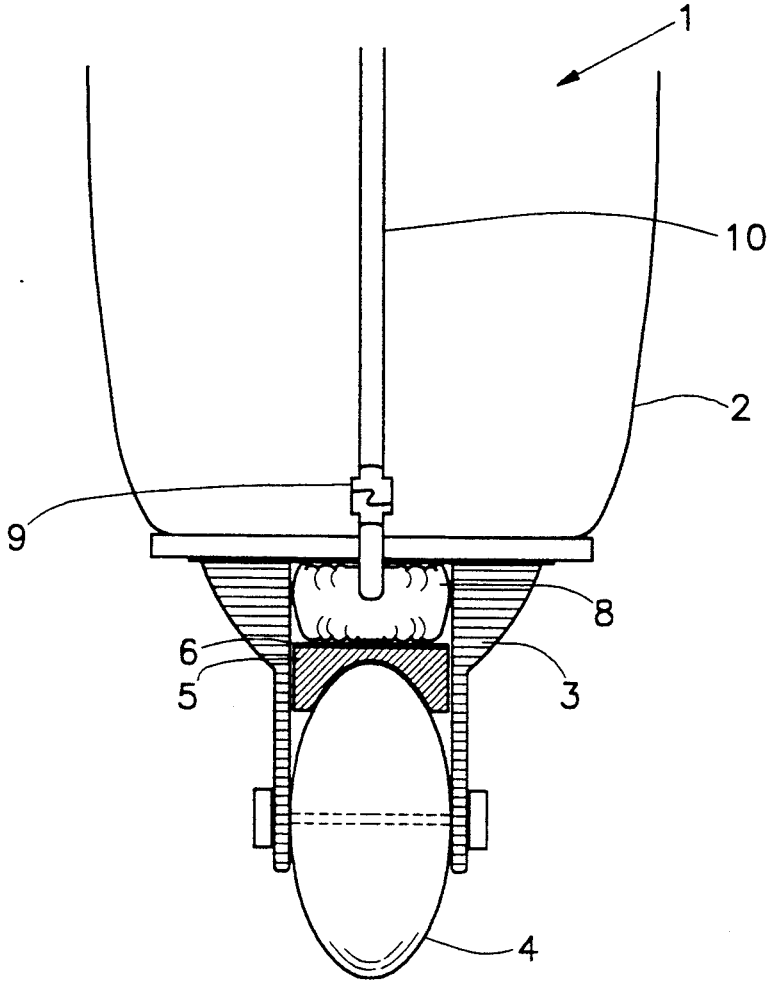
FIG. 4 is a rear elevation view of a typical in-line roller skate with the brake assembly of the present invention in an active state.

The present invention contemplates an improved braking apparatus for small recreational vehicles, and in particular for an in-line roller skate using a hand operated actuator to force a braking member against the wheels of the skate.

Referring to the drawings, wherein like numerals refer to like components, there is disclosed in FIGS. 1–4, broad aspects of one embodiment of the invention. In FIGS. 1–4, a typical in-line roller skate I embodying the invention is shown. It is to be understood that the present invention may be used with equal facility and advantage in other recreational devices such as conventional roller skates, skateboards, etc., and therefore the following description of roller skates refers to one but not all applications of the invention and is provided for illustrative purposes only.

The typical in-line roller skate 1 includes a boot 2, and a frame 3 mounted on the underside of the boot 2 for carrying a plurality of substantially identical wheels 4 in tandem. Each wheel 4 includes its own precision bearing (not shown) that is in intimate contact with an axle that is attached on both ends to the frame 3 for supporting the wheel thereon. The wheel 4 is typically composed of a synthetic plastic or elastomer such as polyurethane that is resilient and has good vibration damping characteristics.

In one embodiment of the present invention, the frame 3 also carries a brake assembly running the length of the frame 3 thereof, mounted above the wheels 4 and below the underside of the boot 2.

Referring now to the brake assembly itself, the first embodiment shown in FIGS. 1–4, comprises a housing plate or brake member (hereinafter referred to as a "brake bar") 6 having at least one brake shoe 5 mounted thereon and positioned above the upper surface of the wheels 4. The brake bar 6 is displaced by at least one spring 7 and preferably a plurality of return springs 7, which are each attached on one end to the brake bar 6 and on the other end to the frame 3 to bias the brake shoes 5 in a normal condition away from the wheels 4. The return springs 7 may be positioned along the sides of the frame 3 as shown in FIGS. 1–4, or alternatively they may be positioned at the front and rear of the frame 3, at the underside of the heel and toe portions of the boot 2.

The brake assembly further comprises an inflatable bladder 8 placed between the bottom surface of the boot 2 and the upper surface of the brake bar 6 that, upon inflation, causes the brake shoes 5 to be forced into contact with the wheels 4. The inflatable bladder 8 is sealingly connected to one end of a brake line 10. The brake line 10, which may be comprised of a hollow plastic conduit or tube, is connected on the other end to a hand squeezable bulb 12, by a two-way valve 11 or stopcock. The bladder, the brake line 10, the valve 11 and the bulb 12 are arranged to form an airtight assembly.

It is preferable, but not required, to have the brake line 10 connected to the bladder by a quick connect/disconnect coupling 9 of the type commonly used for plastic tubing and available in the industry. This arrangement would facilitate detachment of the brake line be from the in-line roller skate 1 and allow conventional use of the skate 1. The bladder, brake bar 6 and brake shoe 5 would remain with the skate 1, rendering the braking apparatus unobtrusive and facilitate preparation for use, handling, sitting and storage of the skate 1. With the use of this coupling 9, reattachment of the brake line 10 is equally simple when the braking function is desired.

In addition, an optional T-connector 13 may be located on the brake line 10 between the bulb 12 and the bladder 8 to allow the brake line 10 of the second in-line roller skate 1 to be connected to the same bulb 12. With this arrangement, a user would need to squeeze only one bulb 12 to activate the brakes of both skates 1. Alternatively, each braking apparatus of an in-line roller skate 1 may have the inflatable bladder 8 connected to a separate valve 11 and a separate hand squeezable bulb 12, respectively.

In a preferred embodiment, the essential mechanical components are made from a durable metal such as steel, although aluminum or other light weight alloys may be used for housings and other parts. The brake shoes 5 may be formed with a longitudinal groove, such that the shape of the frictional surface is complimentary to the shape of the outer surface of the wheels 4 that it will contact. It will be understood that although the embodiment shown in FIGS. 1–4 contains brake shoes 5 that are designed to engage only the front and rear wheels 4, the brake shoe 5 may be designed to engage all four wheels 4 simultaneously, and still be within the scope of this invention.

In all cases, the brake shoes 5 are preferably composed of a material having a hardness that is equal to or less than the hardness of the wheels 4 to enable the brake shoes 5 to wear out without wearing out the wheels 4. For example, the brake shoes 5 may be made of a plastic material which is slightly softer than the material which constitutes the wheels 4 so that the brake shoes 5 do not cause the wheels 4 to wear out.

In a preferred embodiment, the brake shoes 5 are designed in a form to be attached to the brake bar 6 so that they may be easily disengaged and replaced upon wearing down. However, it should be noted that although it is preferable to design the invention so that worn brake shoes 5 may be replaced in a simple manner, the brake shoes 5 may in fact be formed as an integral and contoured part of the brake bar 6.

The inflatable bladder 8 preferably consists of a high strength flexible material slightly elastic under inflation. Several known materials may be used to form the inflatable bladder 8. For example, the bladder e may be made from a polymeric material such as polyvinyl-chloride, polyethylene terephthlate, commonly known as PET, or a silicone elastomeric material such as "Silastic" sold by Dow Corning. It is important to note that the particular type of material used for the bladder 8 is not critical to the invention, and other flexible materials suitable for accomplishing the function of providing a fluid controlled expandable chamber may also be used. Although it is anticipated that the fluid used will be air, any suitable type of hydraulic fluid may be used in the invention. As will be appreciated, a fluid activated brake is preferred for its inherent pressure equalizing feature.

The optional quick connect/disconnect coupling 9 may be a polypropelene thermoplastic coupling 9 of the type available in the industry, such as the CPC couplings sold by Colder Products Co. The brake line 10 connecting the bladder 8 to the hand squeezable bulb 12 may be composed from any of the same materials that the bladder 8 is composed of. The composition of the brake line 10 is also not critical to the invention as long as the function of an airtight conduit to transmit pressure applied to the bulb 12, on to the bladder 8 is provided.

Figure 5:
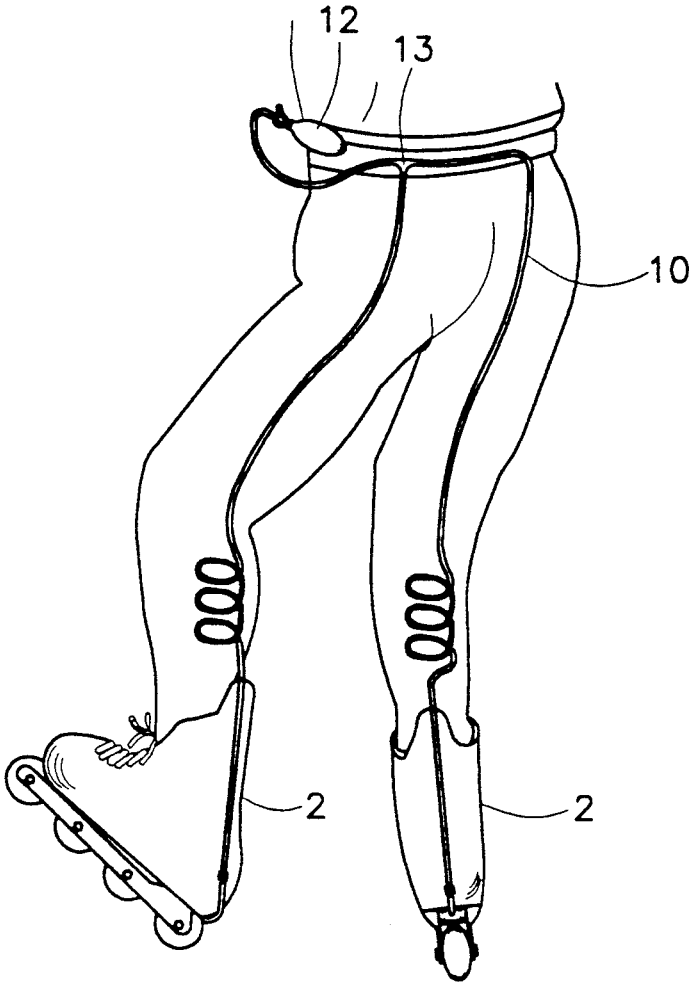
FIG. 5 is a perspective view of a pair of in-line roller skates including the brake and hand controlled arrangement of the present invention.

In a preferred embodiment, the brake line 10 between the bladder 8 and the bulb 12 may be coiled in several spring-like spiralling loops to reduce the stress caused by active motion of the legs, while still being able to provide immediate but gentle stopping of the wheels 4. As will be appreciated, this arrangement also provides the advantage of using one length of brake line 10 tubing for all sizes of riders. This coiling feature draws in any slack tubing by virtue of the spring tension such that when the rider is in the crouched position as opposed to a more upright position, there will not be any unwieldy length of slack tubing. As illustrated in a preferred embodiment shown in FIG. 5, the brake lines 10 of each skate 1 may be coiled and then joined to the valve 11 and bulb 12 via a T-connector with the entire arrangement being secured to a user's belt or waistband for easy access and use.

Figure 6:
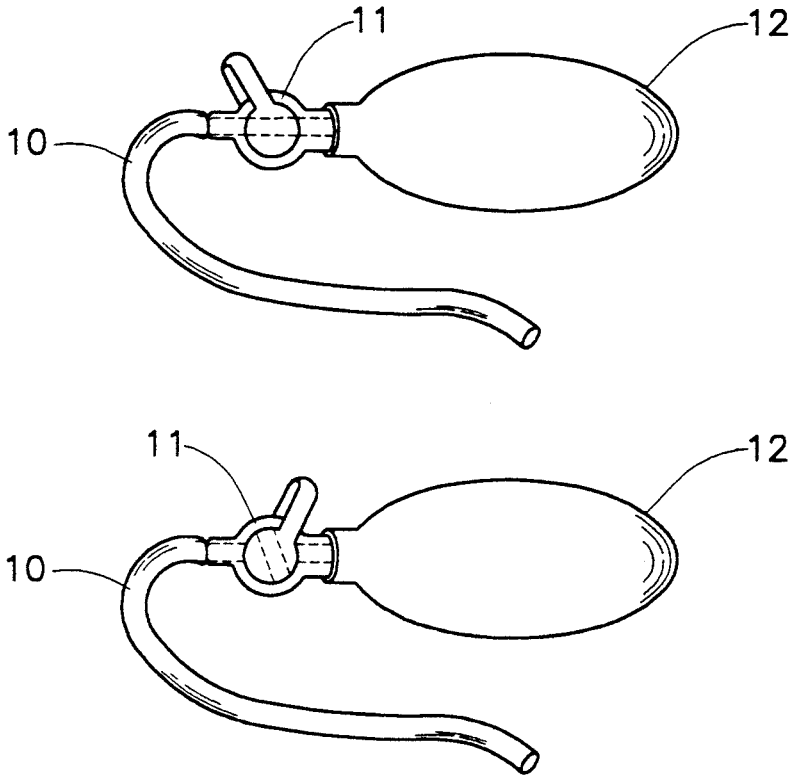
FIG. 6 is two perspective views of a hand operated bulb, and a valve in the open and closed positions, respectively.

Also in a preferred embodiment, the valve 11, of the type common in the industry, will have two positions, namely an open or closed position which may be easily operated by the user's thumb (see FIG. 6). While it is anticipated that the apparatus of the invention will be normally operated with the valve 11 in the open position, closing the valve 11 after compressing the bulb 12 allows the user to "lock" the brake shoe 5 against the wheels 4 to prevent them from rotating. This permits the user to safely walk while wearing the in-line roller skates 1, whenever desirable, or to stand in one place while on gradients or hills. The brake, of course, may be released by setting the valve 11 to the open position.

In operation, braking action is achieved by simply squeezing or compressing the bulb 12 while the valve 11 is in a normal, open position. Pnuematic pressure is thereby transmitted down the brake line 10 to inflate the bladder 8. As the bladder 8 expands, the brake bar 6 is lowered against the force of the return springs 7, causing the brake shoes 5 to apply pressure to the circumference of the spinning wheels 4 (see FIGS. 2 and 4). The speed of the skate 1 may thereby be reduced, and if desired, the skate 1 may be brought to a stop. The frictional contact of the brake shoe 5 against the wheels 4 provides a braking pressure which is proportional to the force applied to the bulb 12. When the pressure is released, the return springs 7 urge the brake shoes 5 up and away from the wheels 4, which are then free to rotate.

Figure 7:
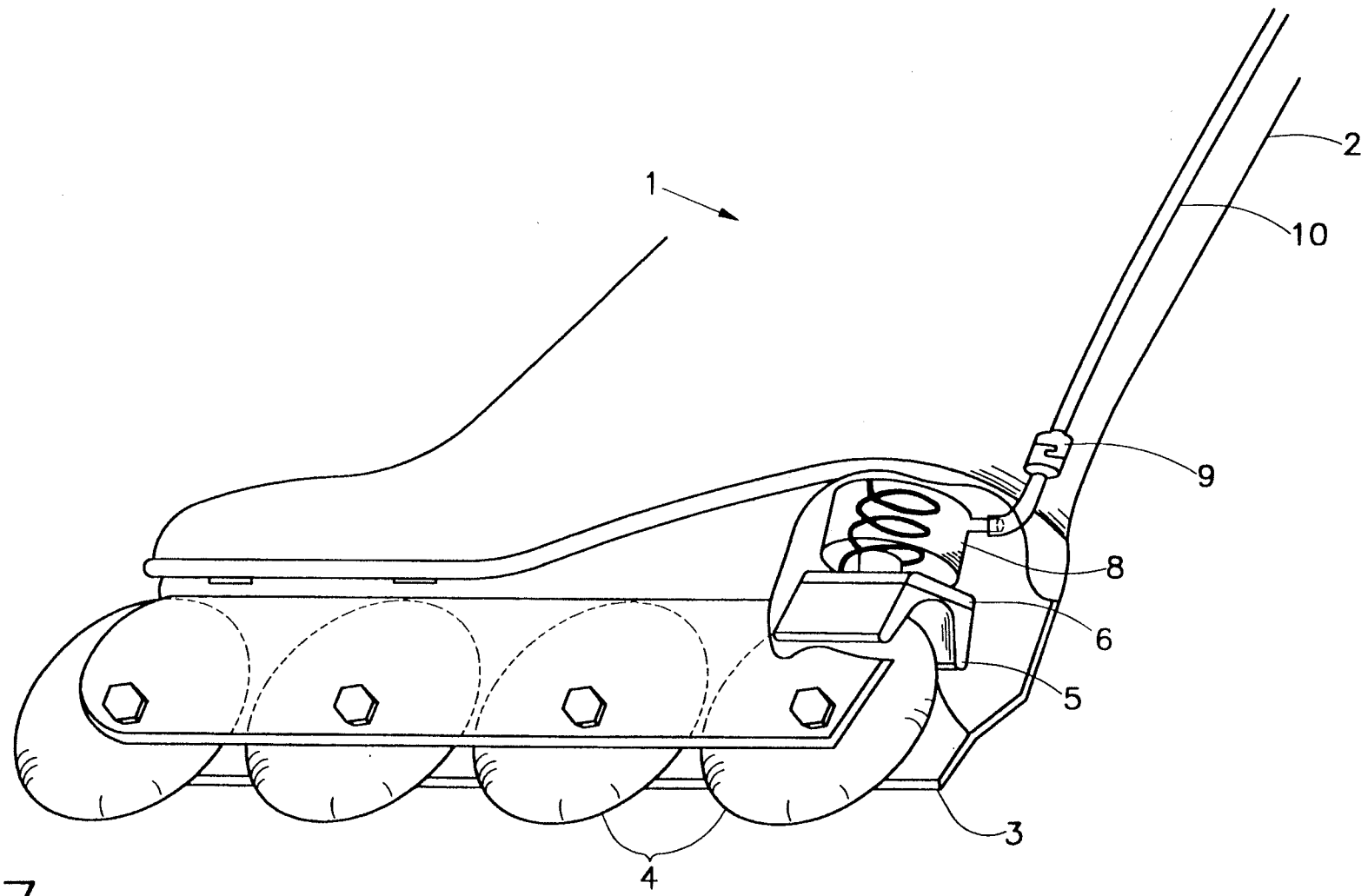
FIG. 7 is a perspective view of a typical in-line roller skate with another embodiment of the present invention wherein the brake is applied using an air cylinder.
Figure 8:
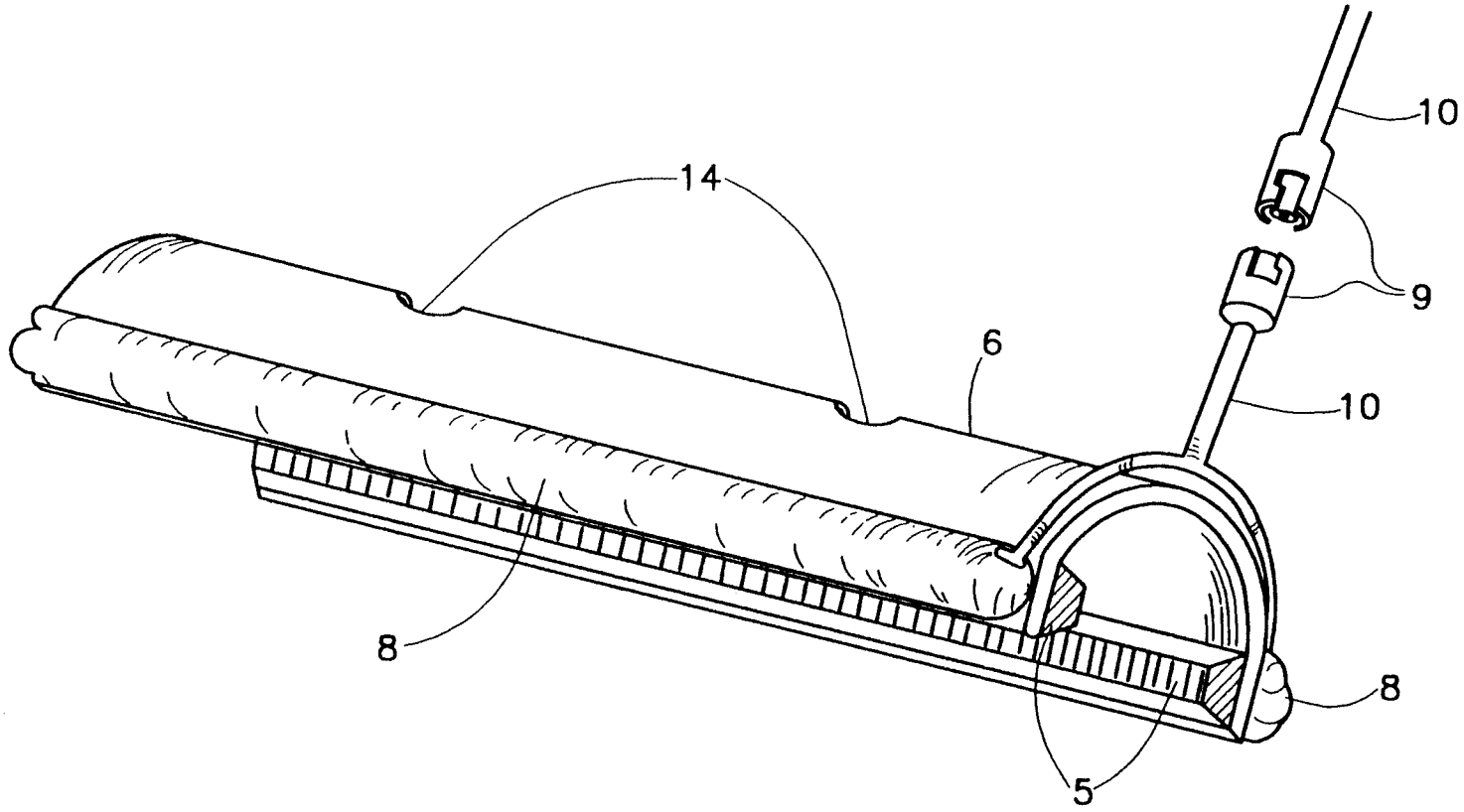
FIG. 8 is a prospective view of yet another embodiment of the present invention wherein the brake shoes are applied to the sides of the wheels.
Figure 9:
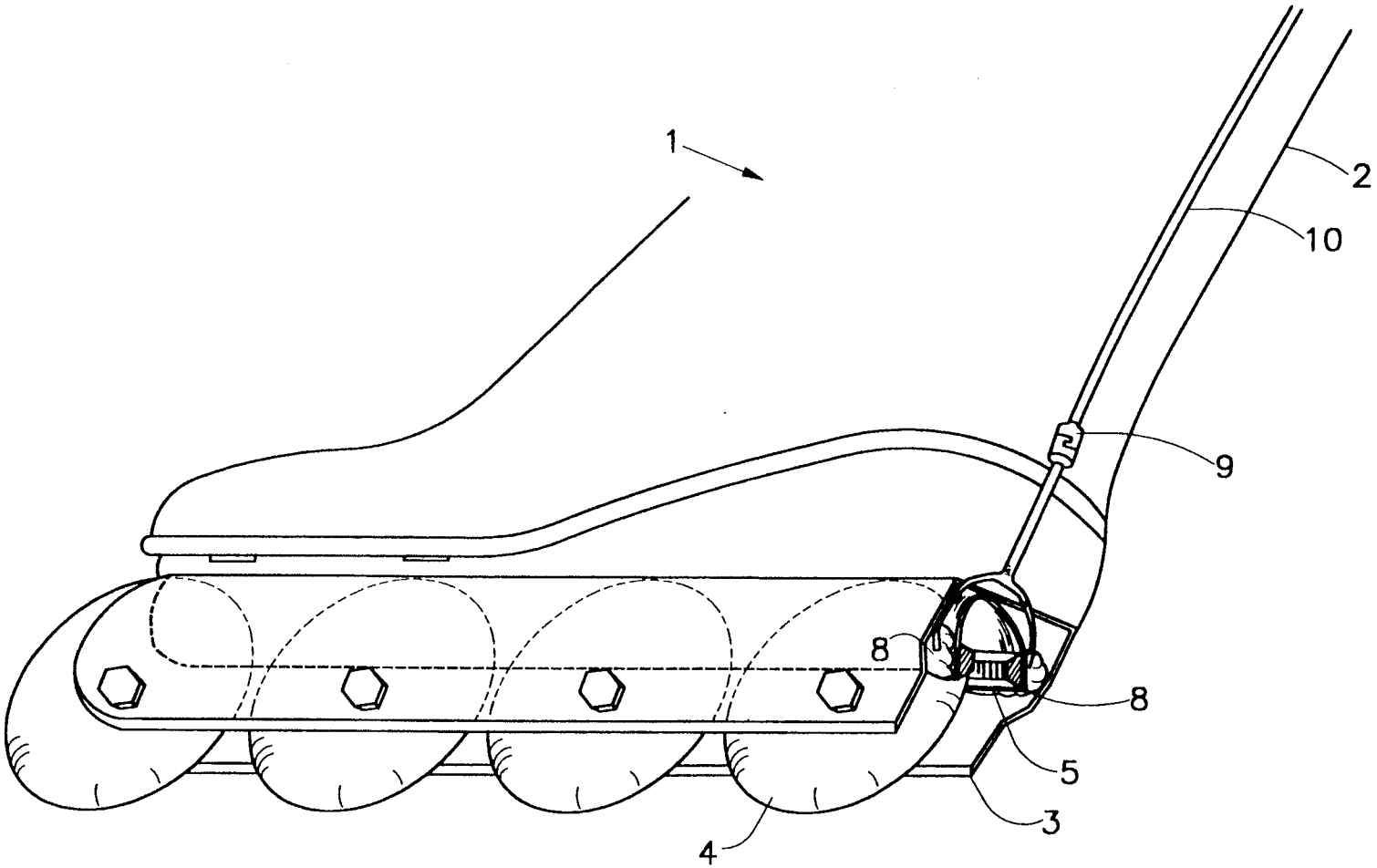
FIG. 9 is a prospective view of a typical in-line roller skate with the embodiment of the present invention that applies a braking force to the sides of the wheels.
Figure 10:
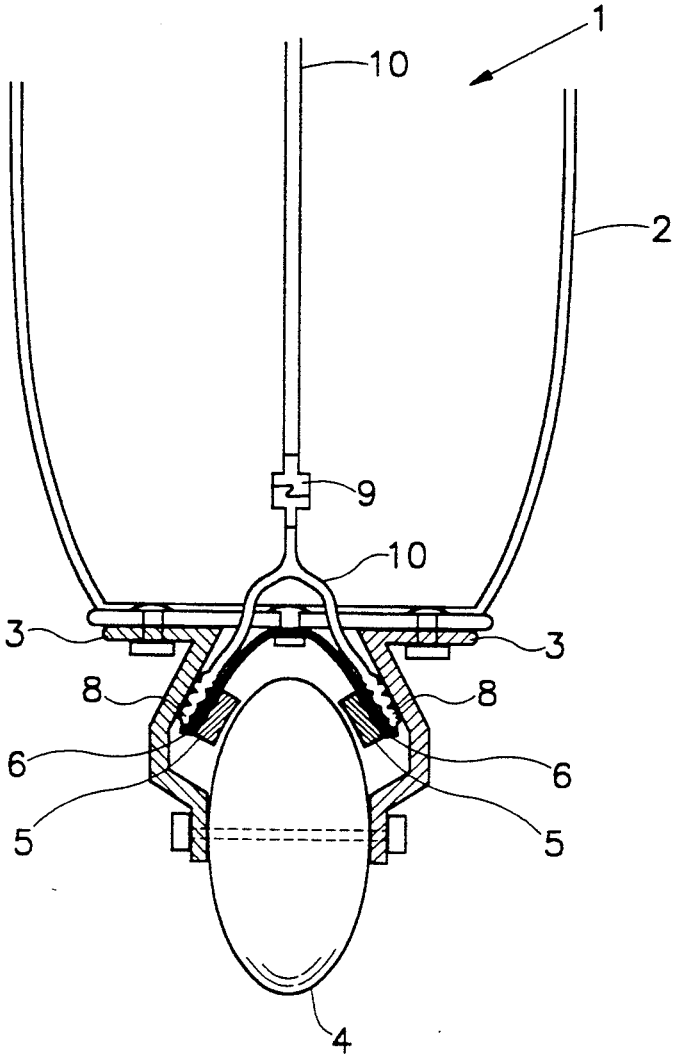
FIG. 10 is a rear elevation view of a typical in-line roller skate in which the brake shoes that are applied to the sides of the roller skate wheels are in an inactive state.
Figure 11:
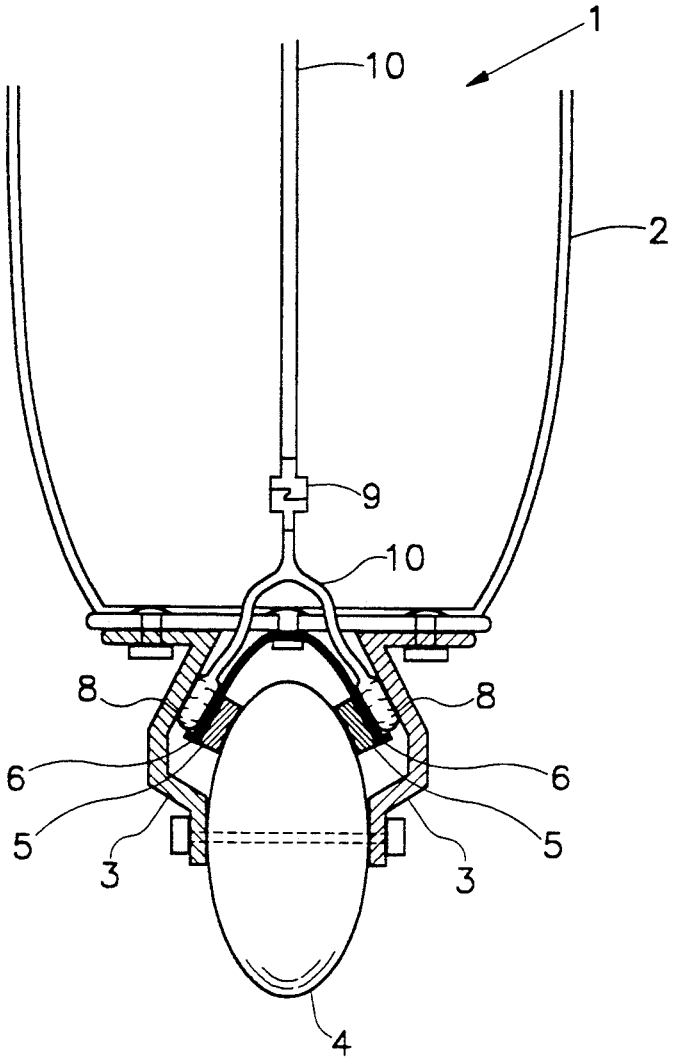
FIG. 11 is a rear elevation view of a typical in-line roller skate in which the brakes that are applied to the sides of the wheels are in an active state.

In a second embodiment shown in FIG. 7, the brake assembly provides for the braking of only one wheel through a piston activated arrangement.

In this embodiment a piston actuated air cylinder 8 is connected through one port to the brake line 10 by a quick connect/disconnect coupling 9, replacing the inflatable bladder 8 in the previous embodiment. The other port of the air cylinder 8 is connected to a brake bar 6 containing a contoured brake shoe 5, as in the first embodiment disclosed. The air cylinder 8 is preferably of the commercially available compact, low profile, self contained type that includes the housing, piston, coil spring, etc. all in one unit, such as the Space Miser air cylinders sold by McMaster-Carr Supply Co.

When the bulb 12 is squeezed, the fluid (air) communicates the pressure to the air cylinder 8 thereby causing the cylinder's pressure member to act on the brake bar 6. Accordingly, the brake shoe 5 is displaced downward and seated against the wheel 4 to effect a braking action. When pressure on the bulb 12 is released, the piston is retracted, drawing the brake bar 6 away from the wheel 4 to its original position.

Although only a braking force as applied to the rear wheel 4 is shown for simplicity, it would also clearly be possible and perhaps desirable in some applications to brake any other of the wheels 4 in addition to or instead of the rear wheel 4 in this embodiment.

Turning to a third embodiment of the braking assembly illustrated in FIGS. 8–11, in this version the brake shoes 5 are applied directly to the side walls of the wheels 4.

In this embodiment, a pair of brake shoes 5 are attached individually to the inner sides of an arch-shaped brake bar 6. The brake bar 6 is positioned adjacent to and around the side walls and upper circumference of the wheels 4, inside the frame 3 and running the length thereof. The brake bar 6 may be mounted to the bottom of the sole of the skate 1 by bolts passing through the slots 14 provided. In a preferred embodiment, the brake bar 6 is formed of a suitable resilient material such a spring steel or plastic.

The brake shoes 5 are mounted along the inner edges of the brake bar 6 in close proximity to the side of the wheels 4 and dimensioned to span the space of the wheels 4. As in the embodiments disclosed above, variations in the design of the brake are possible so that any individual or combination of wheels 4 are braked.

In this embodiment, two inflatable bladders 8 are utilized, each bladder 8 being separately mounted along the length of the outer edge of the brake shoe 5. The bladders 8 are connected to the quick connect/disconnect coupling 9 of the brake line 10 through a Y-configuration conduit.

Braking action is achieved when the bulb 12 is depressed and the two bladders 8 are inflated. Expansion of the bladders 8 causes the brake bar 6 edges to be forced inward by the pnuematic pressure. Advantageously, the oppositely directed brake shoes 5 are brought to bear against the side walls of the wheels 4, thereby exerting a substantial braking force to the wheels 4. Upon release of the pressure the resilient material brake bar 6 will return to its original position, thereby withdrawing the brake shoe 5 away from the wheels 4. As can be appreciated, this embodiment eliminates the need for separate return springs 7 while providing the same end. Furthermore, braking the sides of the wheels 4 instead of the outer circumference of the wheels 4 may avoid any problems caused by dirt, grease, etc. that may be present on the running surface of the wheels 4.

Although the pnuematically (or hydraulically) activated brake using inflatable bladders 8 is preferred in the three disclosed embodiments, a mechanical equivalent could be created with a scissors action activating mechanism. Moreover, although the invention has been described in detail with particular reference to a preferred embodiment thereof, it should be understood that the invention is capable of other and different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed:

1. In combination, a brake assembly for an in-line roller skate comprising a boot and a frame having a plurality of wheels in tandem, said brake assembly comprising:

a brake member disposed below said boot and carried by said frame, wherein said brake member is in close proximity to said wheels;

a longitudinally extending pneumatic pressure-activated member interposed within said frame between said boot and said brake member;

a conduit coupled on one end to said pneumatic pressure-activated member;

a valve coupled to the other end of said conduit, said valve having an open and closed position for maintaining pressure in said pressure-activated member when set in said closed position; and a hand activated means coupled to said valve for applying a force through said valve, said conduit and said pneumatic pressure activated member to said brake member, for biasing said brake member into braking engagement with a plurality of said wheels.

2. A braking assembly according to claim 1, wherein said pneumatic pressure activated member is an inflatable bladder.

3. A braking assembly according to claim 1, wherein said pneumatic pressure activated member is an air cylinder.

4. A braking assembly according to claim 1 wherein said conduit is attached to said pneumatic pressure-activated member by an interlocking coupling that allows the separation and reattachment of said conduit from said pressure-activated member.

5. A method of braking the wheels of an in-line roller skate having a boot, a frame containing said wheels in tandem therein, and a brake assembly having in combination a longitudinally extending pressure activated pneumatic member disposed below said boot within said frame and in fluid communication with an operable hand grip means, wherein said hand grip means is coupled to a valve having an open and closed position for maintaining pressure in said pressure activated member when set in said closed position; and a frictional braking member positioned adjacent to said wheels between said pressure activated pneumatic member and said wheels, said method comprising the steps of:

operating said hand grip means to transmit pressure to said pressure activated pneumatic member, thereby causing said pressure activated pneumatic member to expand and bias said braking member into frictional contact with a plurality of said wheels under the action of said expanding pressure activated pneumatic member.

6. A method of braking the wheels of an in-line roller skate according to claim 5 further comprising the step of setting said valve to said closed position for preventing said braking member from retracting from contact with said wheels after operation of said hand grip means is discontinued.

7. A method of braking the wheels of an in-line roller skate according to claim 5 wherein said conduit and said pressure activated pneumatic member are connected with an interlocking coupling that permits easy connection and disconnection of said conduit and said pressure activated pneumatic member from each other.

* * * * *